US005533759A

United States Patent [19]

Jeffers

[11] Patent Number: 5,533,759

[45] Date of Patent: Jul. 9, 1996

[54] METHOD OF CURRENCY OR DOCUMENT VALIDATION BY USE OF A TEMPERATURE SENSITIVE MAGNETIC PATTERN

[75] Inventor: Frederick J. Jeffers, Escondido, Calif.

[73] Assignee: Eastman Kodak Company, Rochester, N.Y.

[21] Appl. No.: 305,227

[22] Filed: Sep. 13, 1994

[51] Int. Cl.[6] ..... B42D 15/00

[52] U.S. Cl. ..... 283/70; 283/57; 283/82

[58] Field of Search ..... 283/57, 67, 70, 283/82, 902; 324/203, 214, 228, 260

[56] References Cited

U.S. PATENT DOCUMENTS

| | | | |
|---|---|---|---|
| 3,883,892 | 5/1975 | Kneller et al. | 360/59 |
| 4,081,132 | 3/1978 | Pearce | 235/493 |
| 4,186,944 | 2/1980 | Pearce | 283/8 R |
| 4,268,983 | 5/1981 | Cook | 40/2.2 |
| 4,396,886 | 8/1983 | Koester et al. | 324/212 |
| 4,438,462 | 3/1984 | Koester et al. | 360/2 |
| 4,455,484 | 6/1984 | Whitehead | 235/493 |
| 4,584,529 | 4/1986 | Aoyama | 283/70 |
| 5,190,318 | 3/1993 | Mantegazza | 283/82 |

FOREIGN PATENT DOCUMENTS

| | | | |
|---|---|---|---|
| 118800 | 9/1979 | Japan | 283/82 |

*Primary Examiner*—David P. Bryant
*Attorney, Agent, or Firm*—William F. Noval

[57] ABSTRACT

A low Curie temperature magnetic material (such as chromium dioxide) is used as a magnetic pigment to validate valuable documents such as banknotes. $CrO_2$ is very black in color and is an excellent magnetic recording medium, and has a Curie temperature of 128 degrees C. A region of a banknote or other valuable document is printed with an ink containing $CrO_2$ particles. To test the validity of the document, the magnetic media on the document is subjected to magnetic field having a characteristic spatial pattern; the field of a permanent magnet having alternating magnetic poles is a convenient field source. The banknote, and its magnetized region, is then brought to a temperature of at least 128 degrees C, which is readily accomplished by use of a heat lamp, and the region inspected with a magnetic field sensitive optical reader. If it is a genuine bill whose magnetized region was printed with an ink containing $CrO_2$, the recorded magnetic pattern will have disappeared as the media becomes non-magnetic above its Curie temperature. A counterfeit, if recorded with an ink containing $Fe_3O_4$, will retain the recorded pattern when heated to 128 degrees C, as its Curie temperature is about 585 degrees C.

6 Claims, 3 Drawing Sheets

METHOD OF CURRENCY OR DOCUMENT VALIDATION BY USE OF A TEMPERATURE SENSITIVE MAGNETIC PATTERN

BACKGROUND OF THE INVENTION

1. Field of the Invention

This invention relates to a method of confirming the validity of a valuable document as protection against counterfeiting, and in particular to a method utilizing a magnetic material whose magnetic properties change as a function of temperature.

2. Description Relative to the Prior Art

The counterfeiting of currency, stocks, bonds, credit cards and other valuable documents essential to the orderly and effective carrying on of business and financial activities is a continuing serious problem. The widespread availability of high quality imaging systems and the increasing technological sophistication of the criminal combine to increase the complexity of combatting all forms of counterfeiting.

Currently, considerable resources are being devoted to the development of devices for incorporation into a document which can be detected to validate the document's authenticity. Holograms, opaque print strips and microprinting are examples of such devices, and their effectiveness depends upon the difficulties involved in counterfeiting them.

It is also known in the art to include a magnetically recordable area as an anticounterfeiting indicator on specific regions of banknotes or other valuable documents. Currently the banknote printing ink contains the black magnetic iron oxide $Fe_3O_4$, and the presence of the magnetically detectable oxide is an indicia of genuineness. This material is readily available, and is also a major component of the toner used in many copiers. Resultantly, the effectiveness of $Fe_3O_4$ as an anticounterfeiting measure has declined significantly as counterfeiters have become aware of its use. The anticounterfeiting method of the present invention circumvents this problem by use of materials that would be difficult for the typical counterfeiter to duplicate, and for which the sources of supply are limited. This restriction in the availability of the material is a bottleneck through which an aspiring counterfeiter must squeeze, increasing his vulnerability to detection and exposure.

SUMMARY OF THE INVENTION

Rather than the use of $Fe_3O_4$ magnetic oxide as a magnetic recording indicator on banknotes or other valuable documents as presently practiced, the present invention teaches the use of low Curie temperature magnetic material as a magnetic pigment. Preferably, the Curie temperature is less than 130° C. While a variety of magnetic compounds meet the requirement of having a Curie temperature readily attainable above room temperature, the most highly utilized is $CrO_2$. $CrO_2$ is very black in color and is an excellent magnetic recording medium. In the present invention, the $CrO_2$ is magnetized and then momentarily exposed to a heat source to raise its temperature. In FIG. 1, the magnetization remaining after this temperature cycle is plotted against the maximum temperature attained. The temperature dependence of the remanence of $Cro_2$ is seen to remain substantially independent of temperature at a high value until approximately 120 degrees C, at which point it begins to rapidly decrease, going to zero at the Curie temperature of 128 degrees C. A region of a banknote or other valuable document is printed with an ink containing $Cro_2$ particles. To test the validity of the document, the magnetic media on the document is subjected to a magnetic field having a characteristic spatial distribution; the field of a permanent magnet having alternating magnetic poles is a convenient field source. The banknote, and its magnetized region, is then brought to a temperature of at least 130 degrees C, which is readily accomplished by use of a heat lamp, and the region inspected with a magnetic field sensitive optical reader. If it is a genuine bill whose magnetized region was printed with an ink containing $CrO_2$, the recorded field pattern will have disappeared as the media becomes nonmagnetic above its Curie temperature. A counterfeit, if recorded with an ink containing $Fe_3O_4$ or other high Curie temperature pigment, will retain the recorded pattern when heated above 128 degrees C, as its Curie temperature is far above 128 degrees C.

BRIEF DESCRIPTION OF THE DRAWINGS

The invention will be described with respect to the drawings of which.

DESCRIPTION OF THE PREFERRED EMBODIMENTS

Figure 1:
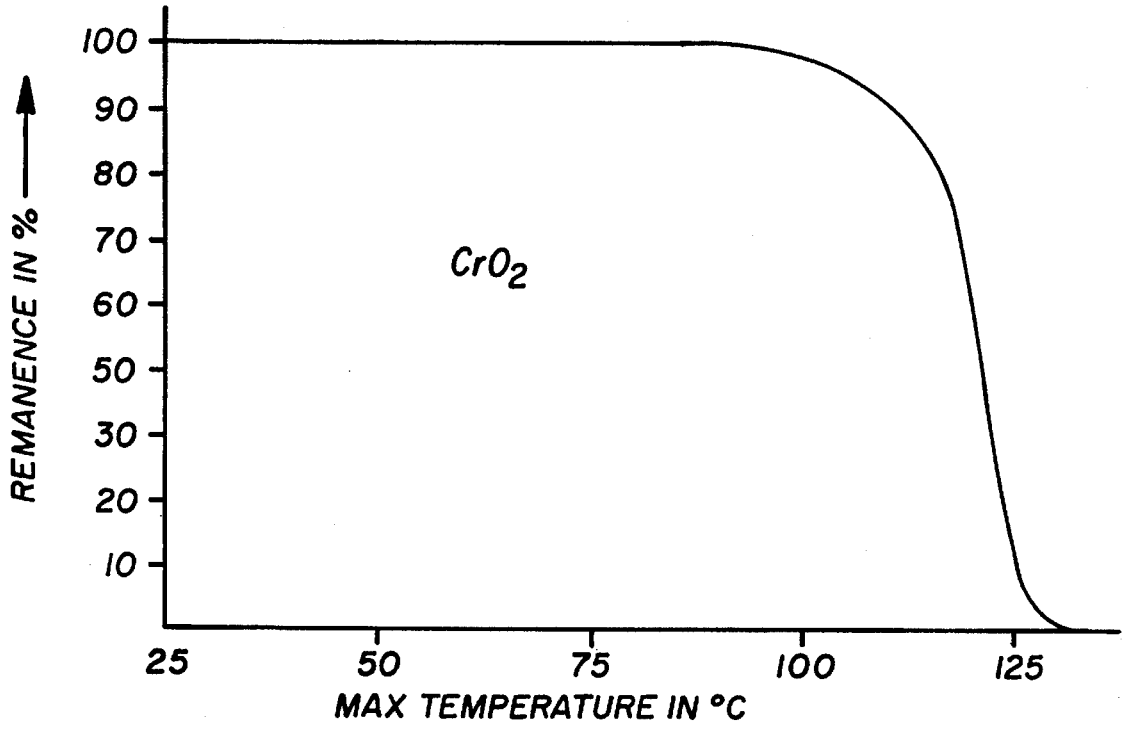
FIG. 1 (PRIOR ART)
FIG. 1 is a graph of relative remanence of $CrO_2$ as a function of temperature.
Figure 2:
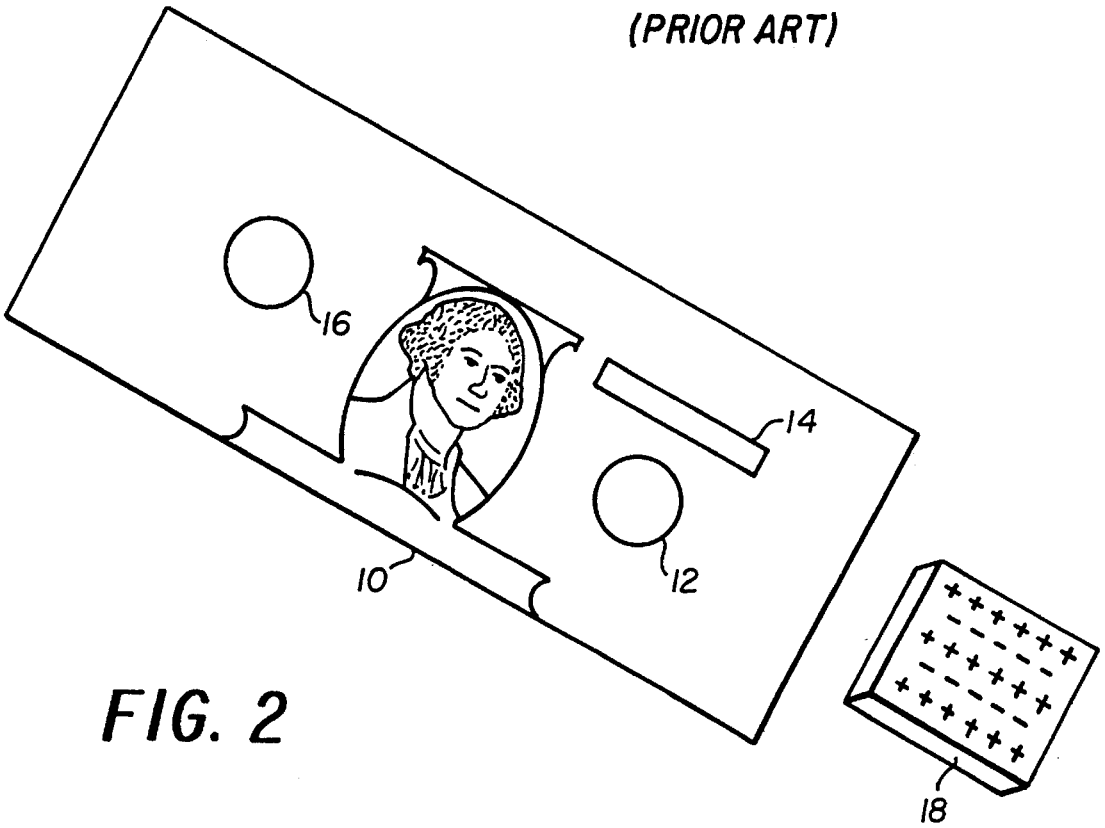
FIG. 2 illustrates a banknote having magnetizable regions thereon, and a method of magnetizing the regions.
Figure 3:
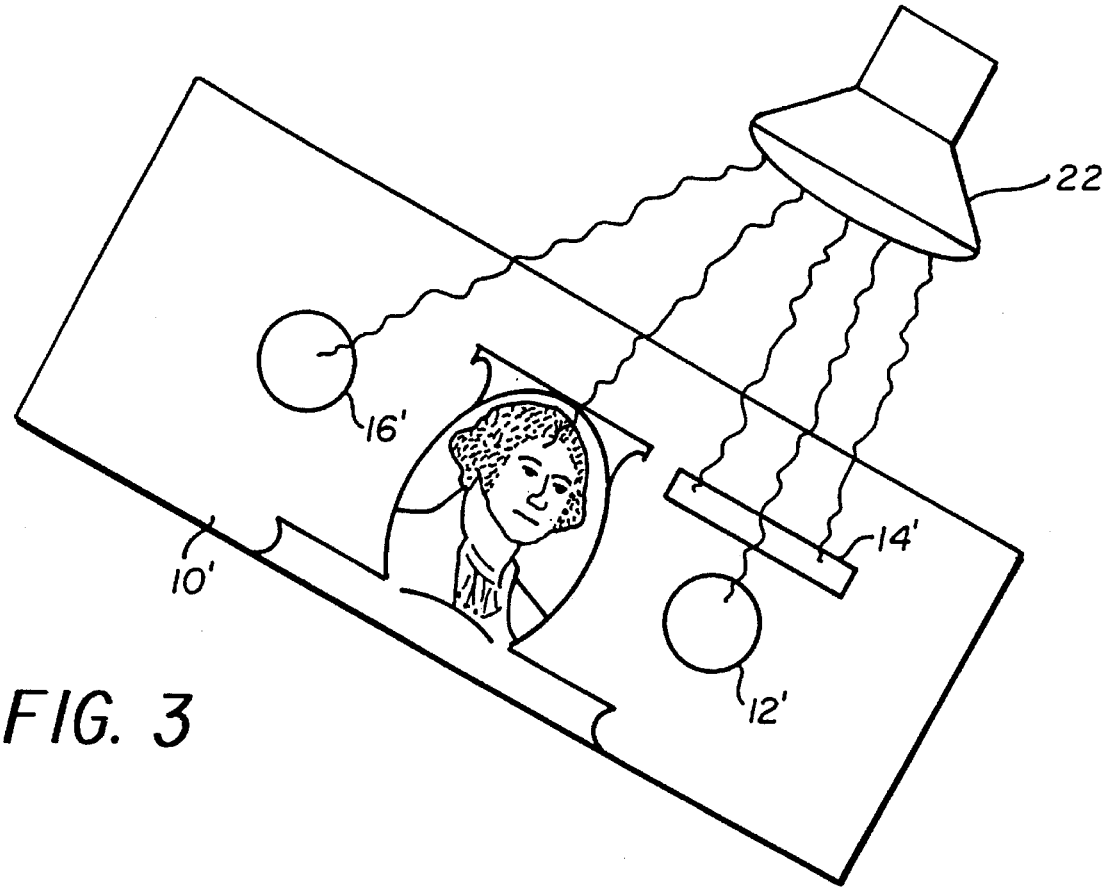
FIG. 3 is a drawing of a means of raising the temperature of the magnetized regions of a banknote.
Figure 4:
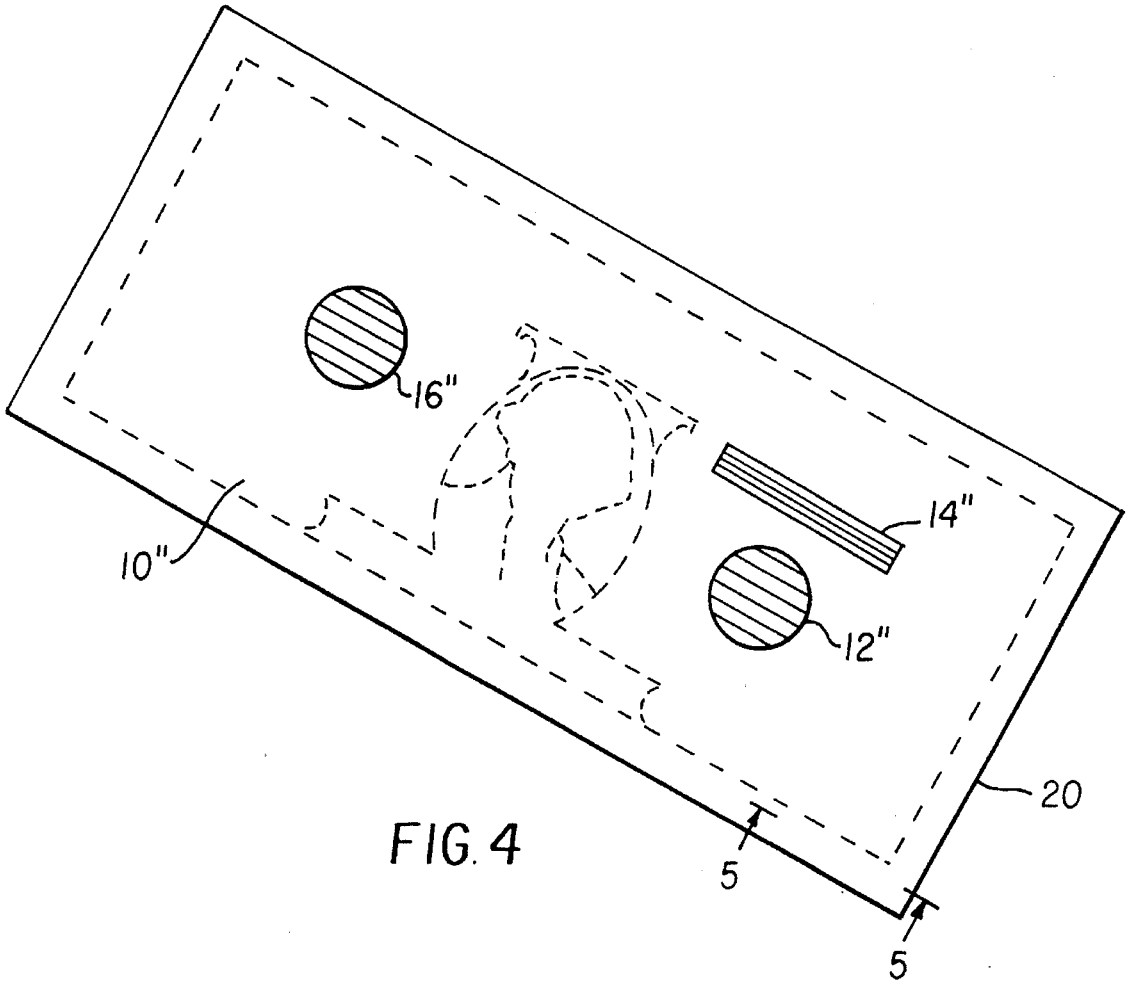
FIG. 4 is a drawing illustrating the viewable magnetic patterns of a banknote having magnetized regions.
Figure 5:
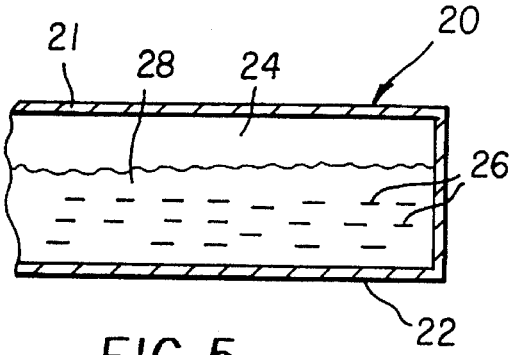
FIG. 5 is a cross-sectional view taken along lines 5—5 in FIG. 4.

Referring to FIG. 2, a banknote 10 has, for example, areas 12,14,16 where the ink used in the printing contains $CrO_2$. To test the validity of the note, a permanent magnet 18, preferably having alternating magnetic poles such as found in the common rubber refrigerator magnet, is passed over the face of the banknote 10, magnetizing the areas 12,14,16. As seen in FIG. 3, the banknote 10' is then placed under a heat lamp 22 which can rapidly raise the surface temperature of the banknote 10' above the Curie temperature of the $CrO_2$ of 128 degrees C. (In the drawings, different but related elements are identified with the same reference characters, albeit that corresponding elements in the various drawings are distinguished by primes.) The next step in the process is to view the banknote 10" through a magnetic viewer 20 treated to be optically responsive to a magnetic field. The magnetic viewer 20 has a clear plastic film 21 and a backing aluminum film 26 form a layered structure having a cavity 24 containing ferrite flakes 26 in water 28. The planes of the ferrite flakes rotate in an applied magnetic field, and remain rotated in the direction the magnetic field after the field is removed. If the banknote remains magnetized after the heat treatment, i.e. the magnetic medium is not $CrO_2$ but is some other magnetic oxide having a much higher Curie temperature, the ferrite flakes in the viewer appears dark where the field lines are normal to the banknote and the film, and will appear bright where the field lines are parallel to the banknote and the film. A suitable viewing sheet is the "3M Viewer," available from Dexter Magnetics, Sunnyvale Calif. 940086. For a counterfeit bill using high Curie temperature magnetic oxide, the patterns are not erased by the elevated temperature, and are observed as shown in the areas 12", 14",16" of FIG. 4. For a genuine bill, the remanence of the magnetic media will have gone to zero due to the heating, and no patterns will be observed.

The method of the invention has been disclosed using $CrO_2$ as the low temperature additive to the printing ink. Table I lists other low temperature Curie temperature magnetic compounds and their Curie temperatures, which may be usable in practice of the invention.

TABLE I

| Compound | Curie Temperature (°C.) |
|---|---|
| CrTe | 93 |
| MnAs | 43 |
| $Ni_2MnGa$ | 106 |
| $Ni_2MnIn$ | 50 |
| $Ni_2MnSn$ | 71 |
| $Ni_2MnSb$ | 87 |
| MnZnFerrite | 100 |

The invention has been described in detail with respect to preferred embodiments thereof, but it will be understood that variations and modifications can be effected within the spirit and the scope of the invention.

What is claimed is:

1. A method for determining the validity of a valuable document, said method comprising the steps of:

a) printing a region of said document with an ink containing a magnetic pigment having a Curie temperature below 130° C.;

b) magnetizing said region with a known magnetic pattern by means of an applied magnetic field;

c) heating said region to a temperature of at least 130° C. with a source of heat; and d) viewing said document by placing a viewing device responsive to a magnetic field over said document to determine if said magnetic pattern has been destroyed by said heating of said region to at least 130°C.

2. The method of claim 1 wherein said magnetic pigment is formulated from one of the following compounds: $CrO_2$, CrTe, MnAs, $Ni_2MnGa$, $Ni_2MnIn$, $Ni_2MnSn$, $Ni_2MnSb$, MnZnFerrite.

3. The method of claim 1 wherein the source of said applied field is a permanent magnet.

4. The method of claim 3 wherein said permanent magnet is a multipole permanent magnet.

5. The method of claim 1 wherein said source of heat is an electric lamp.

6. The method of claim 1 wherein said viewing device comprises a transparent plastic sheet and a backing membrane which form a cavity containing ferrite flakes suspended in water whereby the planes of said ferrite flakes rotate into the direction of the magnetic field generated by said magnetic pattern when said viewing device is placed over said document.

* * * * *